US005769617A

United States Patent [19]

Glen

[11] Patent Number: 5,769,617

[45] Date of Patent: Jun. 23, 1998

[54] VANE-TYPE COMPRESSOR EXHIBITING EFFICIENCY IMPROVEMENTS AND LOW FABRICATION COST

[75] Inventor: John Stewart Glen, Deep River, Canada

[73] Assignee: Refrigeration Development Company, Deep River, Canada

[21] Appl. No.: 740,565

[22] Filed: Oct. 30, 1996

[51] Int. Cl.[6] ..... F01C 11/00; F01C 19/02; F01C 21/02; F01C 21/04

[52] U.S. Cl. ..... 418/13; 418/15; 418/77; 418/87; 418/93; 418/133; 418/143; 418/215; 418/270

[58] Field of Search ..... 418/13, 15, 77, 418/87, 93, 133, 143, 178, 212, 270, 210, 215; 62/116

[56] References Cited

U.S. PATENT DOCUMENTS

| | | | |
|---|---|---|---|
| 727,677 | 5/1903 | Olson | 418/13 |
| 806,451 | 12/1905 | Barr et al. | 418/215 |
| 1,509,917 | 9/1924 | Westinghouse | 418/87 |
| 1,586,806 | 6/1926 | Hohagen | 418/212 |
| 1,616,913 | 2/1927 | McCallum | 418/87 |
| 2,126,247 | 8/1938 | Eppers | 418/13 |
| 3,178,102 | 4/1965 | Grisbrook | 418/13 |
| 3,826,597 | 7/1974 | Schmitz | 418/270 |
| 3,956,904 | 5/1976 | Edwards | 418/210 |
| 4,017,285 | 4/1977 | Edwards | 418/13 |
| 4,403,929 | 9/1983 | Nagasaku et al. | 418/93 |
| 5,181,490 | 1/1993 | Ruzic | 418/143 |
| 5,310,326 | 5/1994 | Gui et al. | 418/77 |
| 5,466,135 | 11/1995 | Draskovits et al. | 418/15 |

FOREIGN PATENT DOCUMENTS

| | | | |
|---|---|---|---|
| 2-99789 | 4/1990 | Japan | 418/77 |

*Primary Examiner*—John J. Vrablik

[57] ABSTRACT

A rotary sliding-vane compressor is described which contains a single rotor with compressor and expander sections, together with a reduced number of parts and efficiency improvements compared to conventional compressors.

8 Claims, 6 Drawing Sheets

VANE-TYPE COMPRESSOR EXHIBITING EFFICIENCY IMPROVEMENTS AND LOW FABRICATION COST

FIELD OF INVENTION

This invention is related to rotary sliding vane compressors, and in particular to those with integral compressor and expander sections that can operate on a thermodynamic cycle approaching the ideal Carnot cycle.

BACKGROUND

Vane-type compressors are currently in production, and are used particularly in automobile air-conditioning systems. Such compressors could compete even more advantageously if construction costs were reduced, and power consumption made significantly less than competitors. This invention shows how these objectives can be achieved.

SUMMARY OF INVENTION

An earlier patent application (U.S. Ser. No. 08/454,823) disclosed how, by adding an integral expander rotor to a conventional compressor rotor, operation on a new thermodynamic cycle approaching the ideal Carnot cycle could be achieved. This is a major step towards raising efficiency, and thereby reducing power consumption. However, to fully exploit the potential of the vane-type machine it is necessary to minimize the still significant internal leakage and friction losses. Coincidental with this fluid loss reduction, it is also desirable to simplify the construction and thereby fabrication cost. Both these objectives are achieved in the invention as outlined below.

The first simplifying step is to fabricate the rotor as a single sub-assembly with a solid section separating compressor and expander regions, as shown in FIG. 1. The rotor can now be assembled from one end, as shown in FIG. 2, providing a fme clearance seal at the outer diameter of the rotor. A further simplification, and reduction of parts, occurs by making the oil sump and reed valve assembly integral with the end plate, as shown in FIG. 2. A third simplification occurs by making in one piece, the compressor/expander casing, separating web, sump casing and end plate. The eight castings, or machined components, of some proprietary compressors can be reduced to only two components. Consequently, casting and machining costs are greatly reduced, as well as reduction of internal energy losses, as discussed below.

Internal refrigerant leakage and suction gas heating are typically the major energy losses caused by oil leakage, though friction is also significant. (Oil leakage is most significant where the rotor almost touches the casing, and also across the flat end faces of the rotor. The solution, therefor, is to operate using an appropriate oil with much greater viscosity than conventional. This reduces oil leakage at the expense of increased oil shear and hence friction, particularly at the flat end faces of the rotor.

Oil shear at the flat rotor end faces can be reduced by relief of the rotor surface over a significant area. To avoid rubbing friction and wear to the rotor flat faces or abutting parts, the use of two low cost thrust bearings can be employed. Such bearings also facilitate simple construction. However, it is necessary to ensure that fluid pressure loads on the rotor are somewhat balanced, and do not result in overloading the thrust bearings. This is achieved by ensuring that oil flows past each flat face of the floating rotor.

Leakage of oil is typically by laminar flow in the fine gaps, and hence is proportional to the clearance (h) to the power three. Hence, a further leakage reduction is achieved by noting that end face leakage can be reduced by a factor of four if two evenly spaced gaps are used, rather than allowing the rotor to be thrust against one end face of the casing, as is currently done. We get: $h^3+h^3=2h^3$, while for current machines with all the clearance (2h) at one side$\{2h\}^3=8h^3$. This is achieved by making the thrust bearing contacting the casing proud by half the total clearance, while the other thrust bearing is set somewhat less proud to allow for any differential axial expansion.

Another advantage of the rotor design shown in FIGS. 1 & 2 is the reduced leakage and friction caused by sharing a common boundary between compressor and expander sections, and thereby eliminating two interfaces. Also, there is no driving pressure differential between compressor and expander sections around much of the circumference at the rotor/casing clearance seat further reducing net leakage.

Ducts for the flowing refrigerant can be either the conventional radial flow type, or positioned for axial intake and discharge from the working sections of the rotating machinery. Axial flow reduces vane tip pressure, and thereby further promotes hydrodynamic lubrication of the vane tip.

Use of a common oiling system greatly simplifies the design. A single high pressure oil sump, and common ducts leading to both the compressor and expander sections, are additional features of the invention. Eliminating vane bounce, and minimizing oil pumping losses via the inboard ends of the vanes are necessary. Generous oil ducting, with full oil flooding, solves the pumping losses problem, and is possible with the thrust bearing arrangement. Bouncing can be inhibited by oil overpressure, regulated via supply through a non-return valve, and return to the sump via an overpressure relief valve.

Compression losses in the ducts leading to the multiple reed valves can be reduced, by shortening the passages. In addition, the reed valves can be made as one assembly to reduce cost, and similarly the backing bars.

An alternative method to make leakage and friction at the rotor flat end faces negligible is by use of proprietary seals. Solid discs are attached to the rotor end faces and provide a continuous surface in contact with the rotary seal.

DETAILED DESCRIPTION

Figure 1:
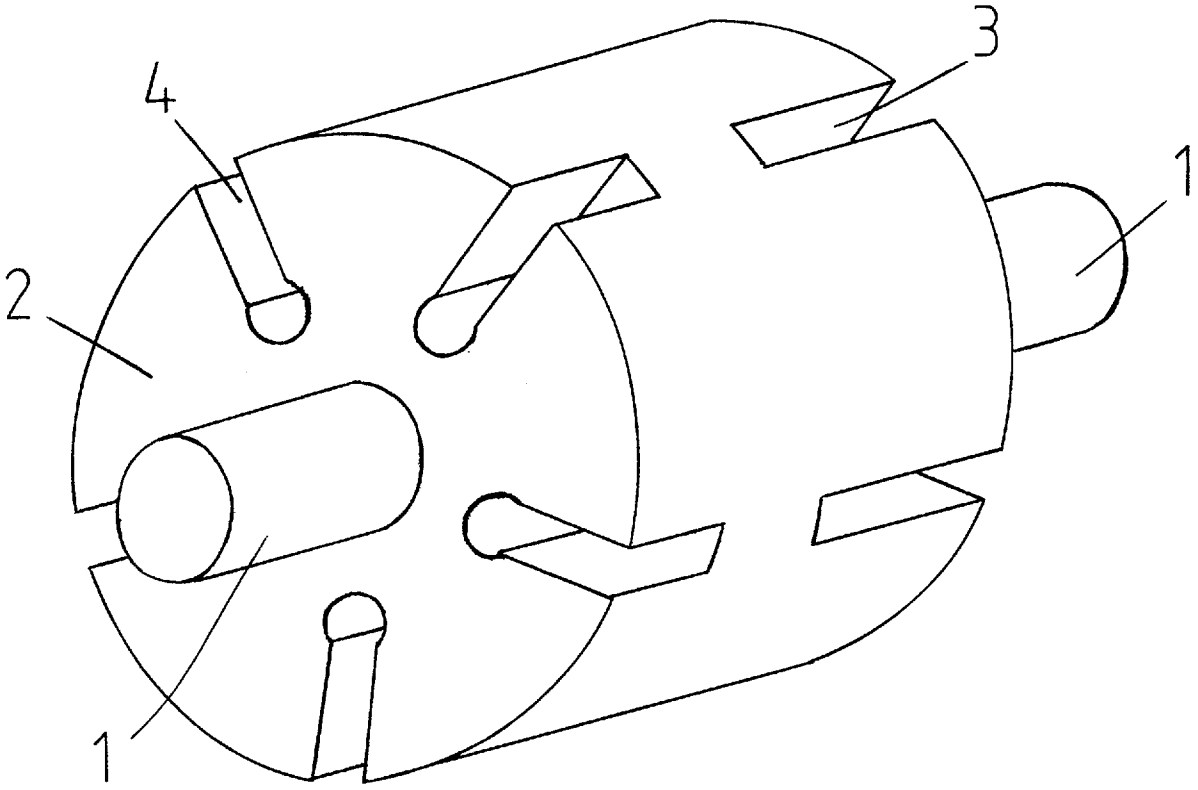
FIG. 1 shows the rotor and shaft configuration.

FIG. 1 indicates the rotor of a rotary vane compressor, showing shaft 1, rotor 2, slots for compressor vanes 3, and slots lor expander vanes 4. The slots can be machined simply using an end mill due to the enlarged inboard ends shown. The rotor 2 can be integral with the shaft or keyed to the shaft and of lighter material, or made from three axial slices with the central slice being solid, if desired.

Figure 2:
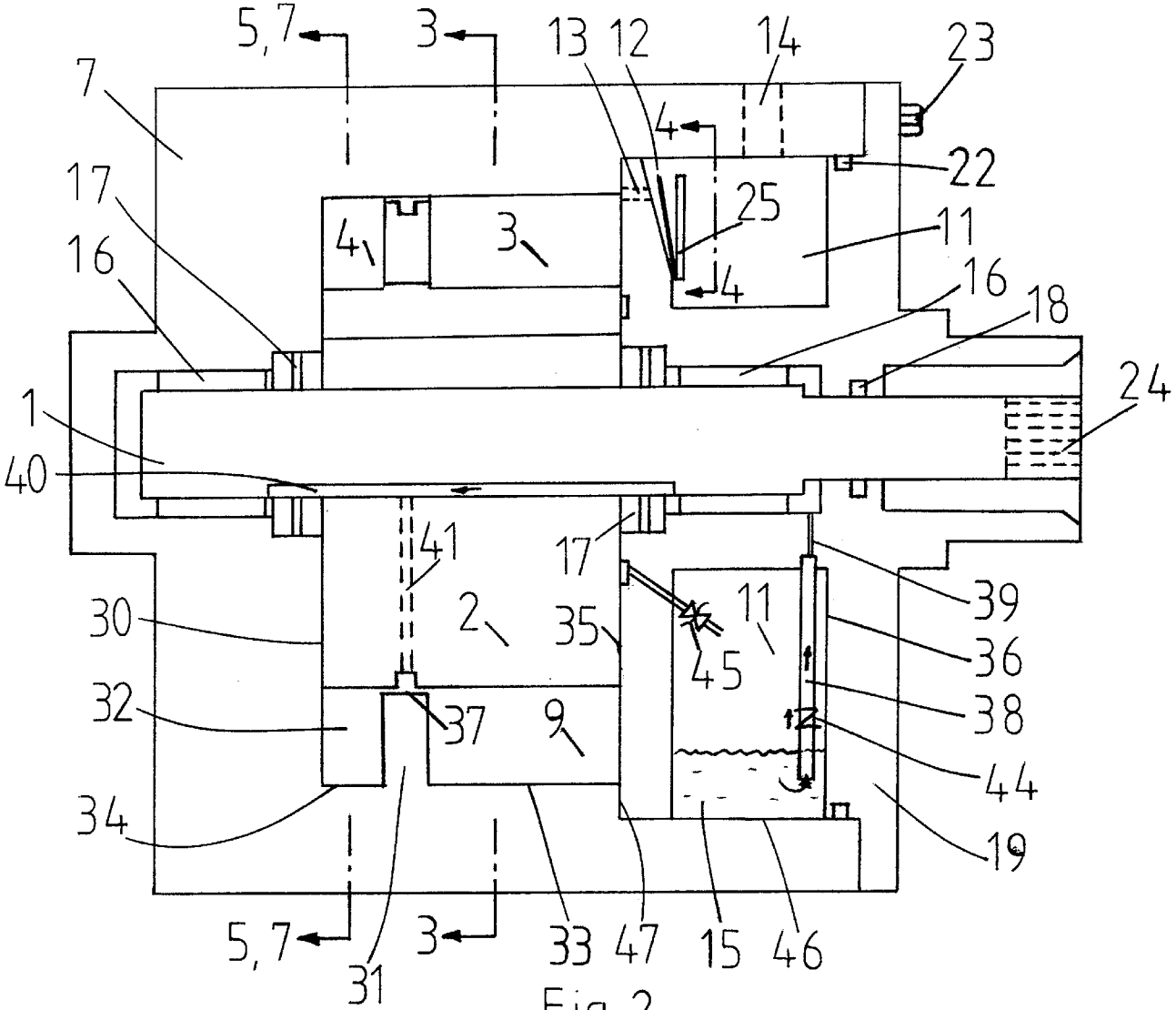
FIG. 2 shows an axial cross section through the compressor and expander.
Figure 3:
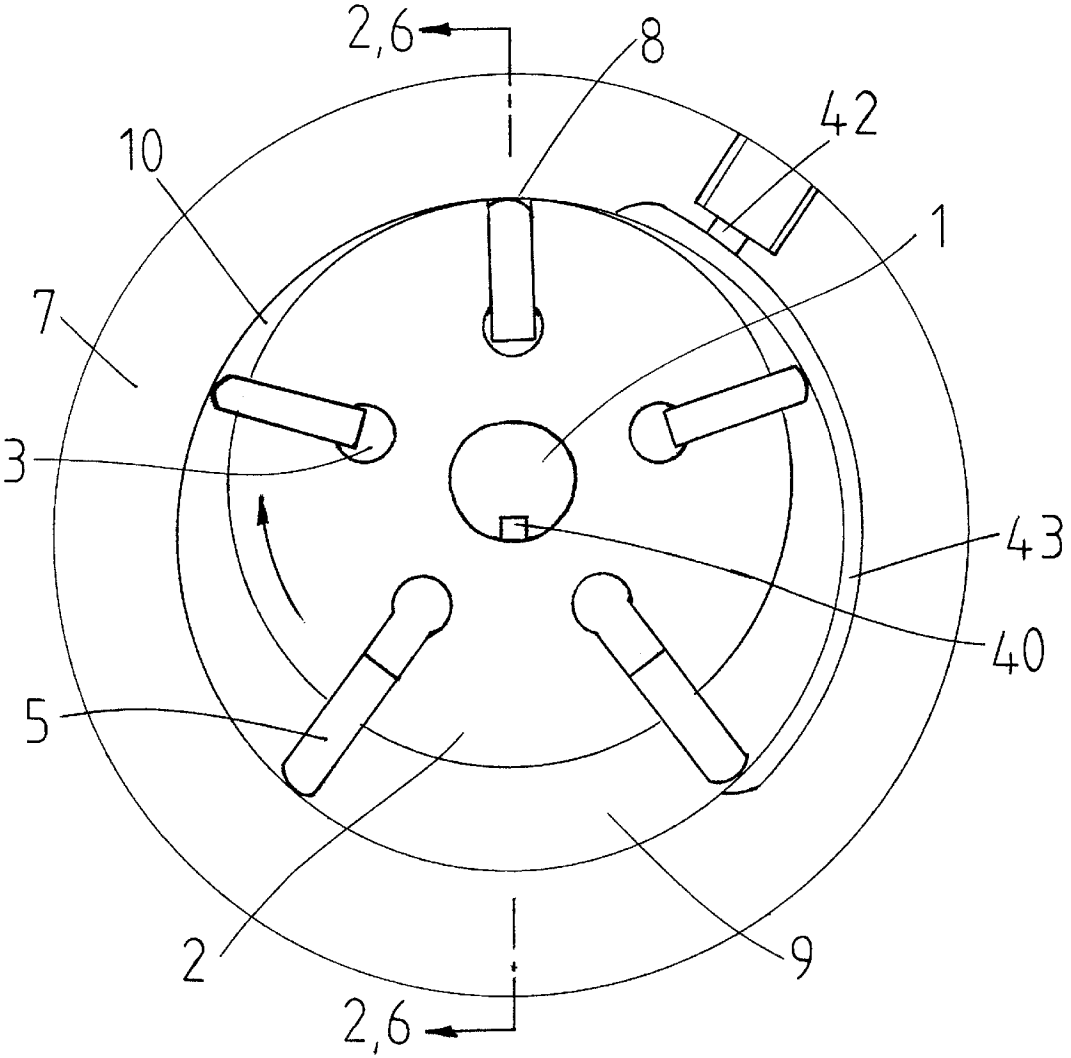
FIG. 3 is a radial cross section through the compressor section.
Figure 5:
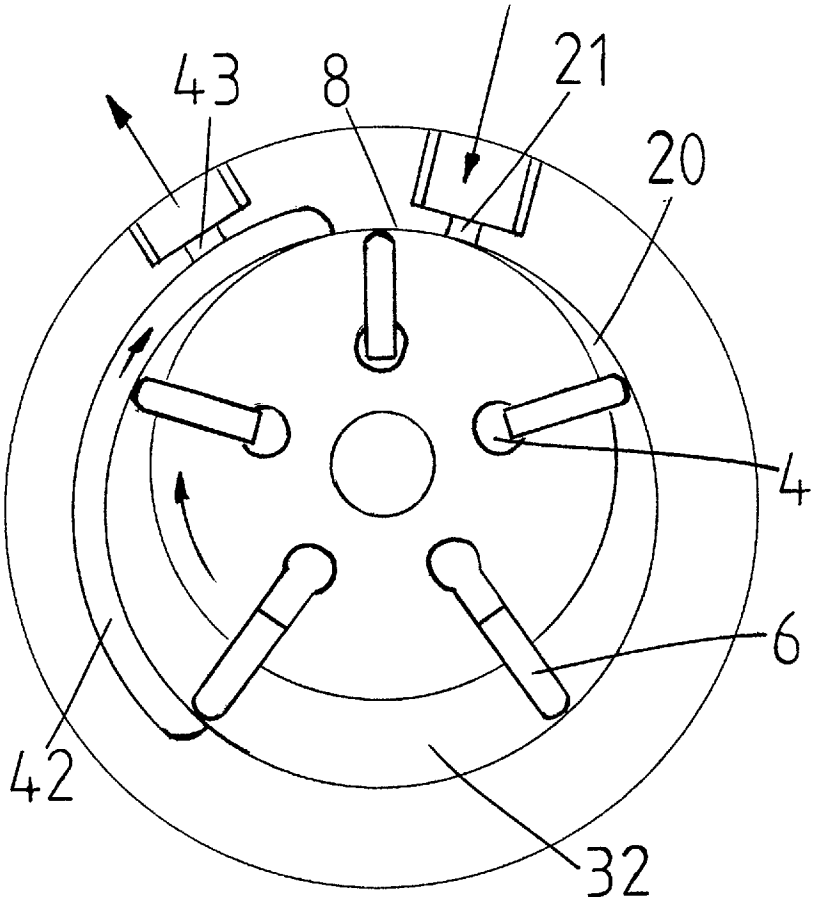
FIG. 5 is a section through the expander region showing a typical radial ducting arrangement.

FIG. 2 indicates an axial section through the assembly, and should be read in conjunction with FIGS. 3 and 5, and shows the shaft 1, rotor 2, compressor section vane slots 3, and expander section vane slots 4. Five vanes 5 can slide in and out in the compressor section slots 3, and similarly another five vanes 6 can slide in and out of the expander section slots 4. The circular rotor 2 is axially offset from the casing 7 such that a minimal clearance 8 exists.

In FIG. 3, the compressor section traps refrigerant vapor in volume 9, supplied via port 42 and duct 43, and compresses it into volume 10 until the pressure generated overcomes the pressure in the discharge- chamber or oil-sump 11, whereupon the reed valves 12 open, and refrigerant passes through multiple chambers 13 into 11. In chamber 11, the oil is separated from the refrigerant, the refrigerant passing to the external refrigeration system via ports 14. The oil 15 collecting at the base of chamber 11 is forced by the chamber pressurized vapor to lubricate shaft bearings 16, thrust bearings 17, and shaft seal 18, via passages 38,39,40, 41. The oil 15 is also used to limit vapor leakage wherever there is a fine clearance between the rotor 2 and casing 7, at interfaces 30,35 and clearance 8, and to lubricate at vanes 5 and 6 contact with adjacent surfaces. Ovepressure created by the inboard ends of the vanes 5,6 can be limited via a non-return valve 44 and relief valve 45.

Figure 7:
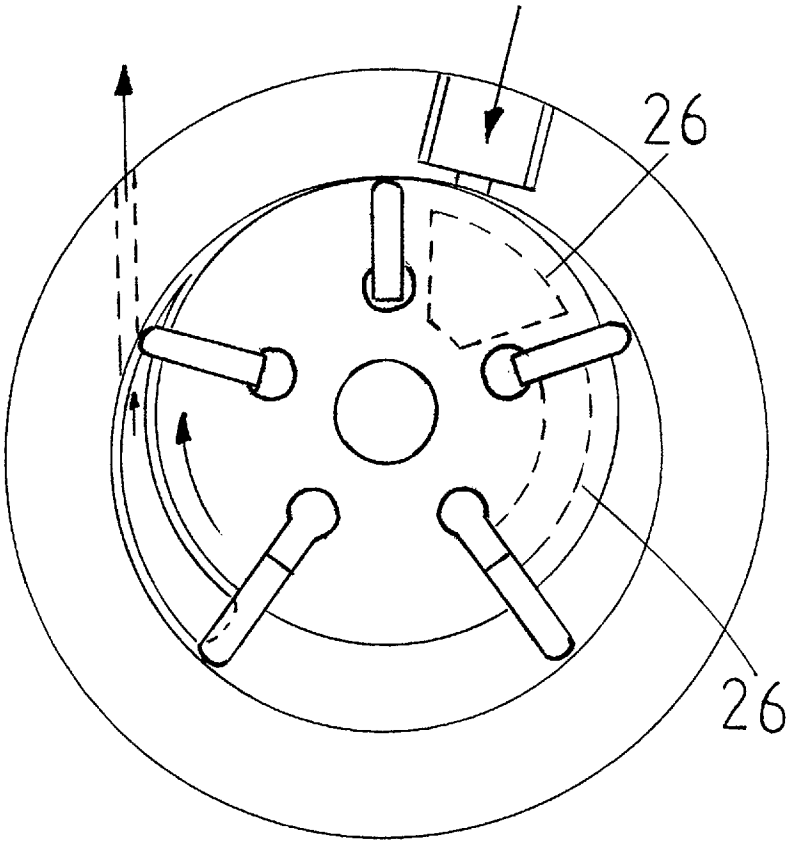
FIG. 7 shows an alternative axial discharge duct arrangement.

FIG. 5 shows the expander. In this case, the high pressure low quality refrigerant vapor, returning from the condenser of the external refrigerant circuit (not shown), passes into chamber 20 via port 21. The volume trapped in chamber 20 as the port 21 is cut off when the next vane 6 passes, expands as the chamber volume increases until volume 32 is reached, thereby recovering fluid compression energy. Discharge of this low pressure two-phase fluid to the evaporator of the external circuit then occurs via ducts 42 and port 43 machined in the casing 7. FIG. 7 shows a typical axial ducting arrangement.

Additional components shown in FIG. 2 are a conventional static seal 22, and closure bolts 23. The spline 24 on the shaft 1 is connected to the external drive (not shown), which is conventionally a clutch and engine driven belt in the case of an automobile compressor. The reed valves 12 can be supported in the open position by a conventional backing bar 25.

FIG. 2 also indicates how the construction is greatly simplified and number of parts reduced. The single casing 7 provides the flat end face 30 abutting the rotor 2, the web 31 separating compressor region 9 from the expander region 32 and creating one wall of the clearance seal 37, the casing of the compressor 33 and expander casing 34, together with the casing 46 of the oil sump/separator region 11.

FIG. 2 also shows how the single component end plate 19 provides a flat boundary 35 to the rotor 2, the end wall 36 and enclosure of the sump/separator region 11 by virtue of the abutting surfaces at 47 and seal 22.

The thrust bearings 17 in FIG. 2 ensure that contact friction between stationary components 7, 19 and rotating component 2 does not occur at interfaces 30, 35. In addition, net leakage energy loss at interfaces 30, 35 is greatly reduced by ensuring approximately equal operating clearances via proudness of thrust bearings 17. Thrust bearing life is made acceptable by ensuring fluid flows past both interfaces 30 and 35, and thereby roughly balancing hydraulic forces on the rotor 2, one thrust bearing carrying the imbalance load.

FIGS. 1, 2 also indicate how the compressor section 9 has only one interface 35, and similarly the expander section 32, has only interface 30 due to the rotor construction. This greatly reduces leakage.

It should also be noted that clearance seal 37 leakage is reduced since, over much of the circumference, the pressure in compressor section 9 equals that in the expander section 32.

FIG. 7 also shows how the flat faces of rotor 2 can typically be relieved 26 to reduce oil shear loss at interfaces 30,35, without affecting vane bounce.

Figure 4:
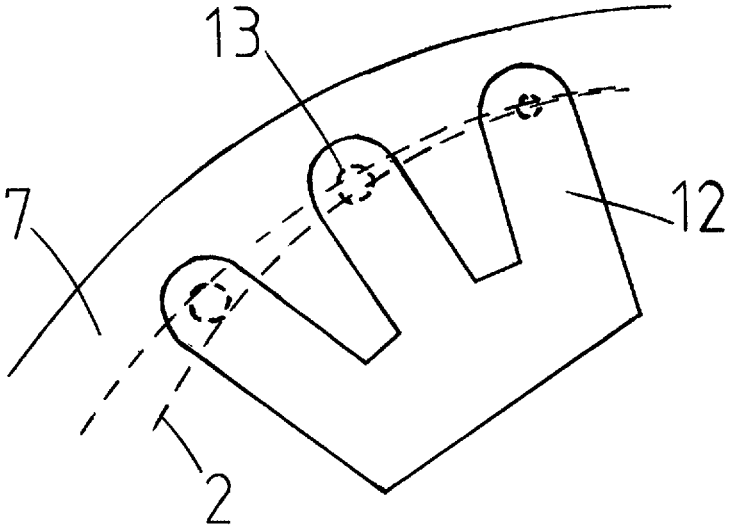
FIG. 4 indicates how multiple reed valves can be made from one piece of material.

FIG. 4 shows how the compressor discharge reed valves can be made from one component.

Figure 6:
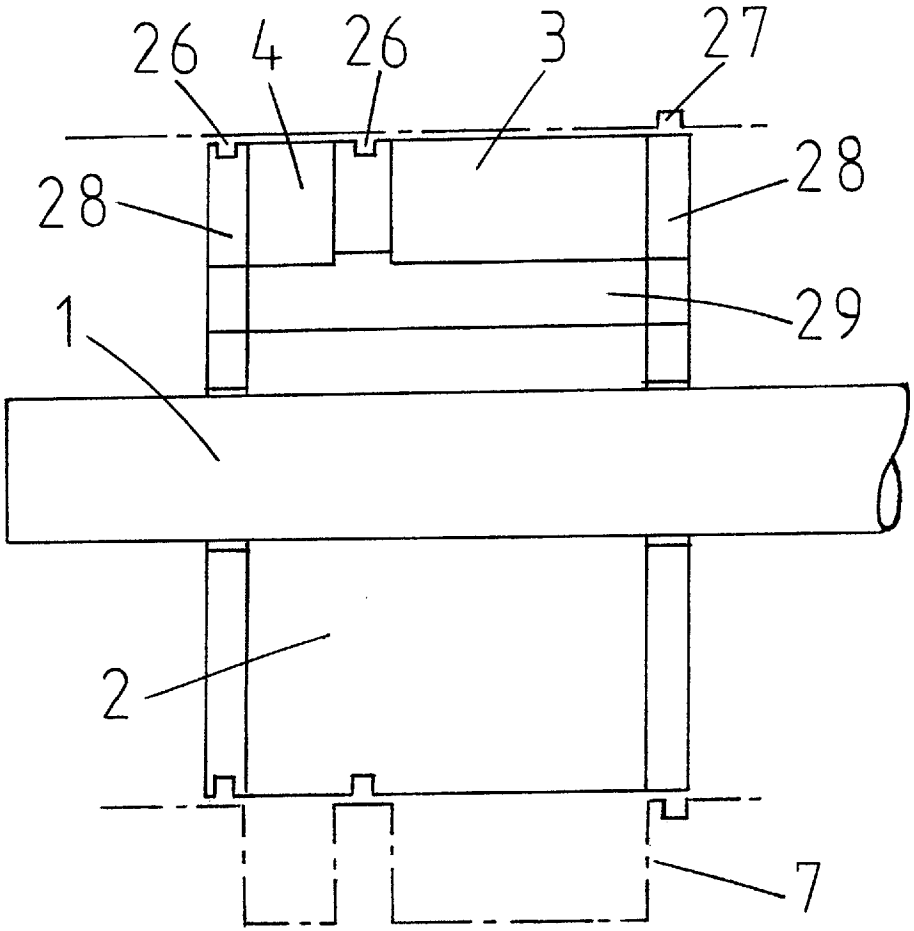
FIG. 6 shows an alternative arrangement, indicating how seals can limit leakage at the flat end faces of the rotor, and at the interlace between compressor and expander regions.

FIG. 6 shows an alternative arrangement to very fine clearances for limiting leakage and friction, by use of rotary seals 26,27. The rotor 2 has circular flat plates 28 attached, and the seals can be mounted in the plates 26 or casing 27. A through oil passage 29 is indicated.

I claim:

1. A rotating vane machine operating on a refrigeration, air-conditioning or heat pump cycle, wherein the compression step occurs in a compressor section, and at least part of the expansion step occurs in an expander section, said compressor and expander sections being located axially relative to each other within a casing machined to provide separate compressor and expander cavities on assembly and having a smooth internal profile, said casing containing a single cylindrical rotor with essentially flat end faces, said casing being such that said rotor can closely clear the casing and be installed from one end, said rotor being integral or keyed to a shaft driven by an external power source and supported by bearings, said rotor containing radial slots containing substantially rectangular vanes in the compressor and expander sections and which have a close fitting arrangement with said casing and flat component boundaries abutting the flat end faces of the rotor, said rotor being eccentrically located within said casing such that an exceedingly close but non-touching relationship exists between said rotor and said casing at their minimum clearance which separates inlet from outlet of the compressor and expander sections respectively, said vanes having a profiled tip where touching said casing, said casing and said vanes having axial lengths and number of vanes to ensure the required volume ratios are achieved for said compressor and expander sections of said refrigeration, air-conditioning or heat pump cycle, said rotating vane machine having reduced oil leakage by using a significantly more viscous oil than normal where said rotor almost touches said casing, and where the increased friction at said flat rotor end faces is reduced by relieving the said end faces over part of their surface, and where thrust bearings are mounted slightly proud in said rotor or abutting surfaces to eliminate rubbing friction, reduce leakage, and simplify construction, said thrust bearings being subjected to acceptable loading by ensuring fluid flows past each flat face of said rotor to limit thrust loading to acceptable values.

2. The rotating vane machine of claim 1 wherein the said casing, and one end face abutting said flat end face of the rotor, casing/rotor clearance wall, and casing of an oil sump, are essentially fabricated from a single piece of material.

3. The rotating vane machine of claim 1 wherein said flat component boundaries abutting the said rotor flat end face is essentially fabricated from one piece of material and contains an oil sump, a machine end plate, a discharge reed valve assembly, an external static casing seal, and a shaft seal.

4. The rotating vane machine of claim 1 wherein a thrust bearing in contact with one end face is set proud by approximately half the net clearance between rotor and abutting end faces, to ensure operational end clearances are approximately equal to minimize leakage, and another bearing is much less proud to accommodate any differential expansion.

5. The rotating vane machine of claim 1 wherein reed valves are fabricated from a single piece of material, supported by a single backing bar, and mounted such that the said discharge chambers leading to said reed valves can be kept to a short length to minimize over-compression losses.

6. The rotating vane machine of claim 1 wherein said casing contains ducts for refrigerant flow to and from the working rotating sections, mounted either for axial or radial flow.

7. The rotating vane machine of claim 1 wherein a common oil system feeds oil to the inboard end of said vanes, and oil can flood all passages, and flow via generous ducts for minimal pumping losses due to vane movement, and where vane bounce can be inhibited if necessary by applying an over-pressure in the oil system via an oil non-return valve supply, and return to the oil sump via an over-pressure relief valve.

8. The rotating vane machine of claim 1 wherein rotary seals are mounted in or adjacent to solid discs attached to each said flat end face of the rotor, and also between said compressor and expander sections.

* * * * *